US008277264B2

(12) United States Patent
Urano

(10) Patent No.: US 8,277,264 B2
(45) Date of Patent: Oct. 2, 2012

(54) CONTACT HAVING INDEPENDENTLY DEFORMABLE SPRING PORTIONS AND CONNECTOR INCLUDING THE CONTACT

(75) Inventor: Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 261 days.

(21) Appl. No.: 12/661,790

(22) Filed: Mar. 24, 2010

(65) Prior Publication Data

US 2010/0267289 A1 Oct. 21, 2010

(30) Foreign Application Priority Data

Apr. 17, 2009 (JP) ..... 2009-101328

(51) Int. Cl.
*H01R 11/22* (2006.01)

(52) U.S. Cl. ..... 439/857

(58) Field of Classification Search ..... 439/232, 439/235, 239, 682, 698, 857
See application file for complete search history.

(56) References Cited

U.S. PATENT DOCUMENTS 4,932,906 A * 6/1990 Kaley et al. ..... 439/857
5,024,610 A * 6/1991 French et al. ..... 439/857
6,568,955 B2 * 5/2003 Hotea et al. ..... 439/495
6,749,470 B2 * 6/2004 Dangelmaier ..... 439/857
7,150,661 B2 * 12/2006 Cisey ..... 439/857

FOREIGN PATENT DOCUMENTS

JP 2007-305559 11/2007
JP 2008-192627 8/2008
JP 2008300145 A * 12/2008
JP 2008300146 A * 12/2008
JP 2008300147 A * 12/2008
KR 2008-0106096 12/2008

OTHER PUBLICATIONS

Korean Office Action dated Jul. 29, 2011 in Korean Patent Application No. 2010-0033421 along with an English translation of same.

* cited by examiner

*Primary Examiner* — Tho D Ta

(74) *Attorney, Agent, or Firm* — Collard & Roe, P.C.

(57) ABSTRACT

A contact is formed of a single metal sheet. The contact includes an upper spring portion configured to press an upper surface of a plate-like connection target in a downward direction and a lower spring portion configured to press a lower surface of the plate-like connection target in an upward direction. The lower spring portion is deformable independently of the upper spring portion.

14 Claims, 10 Drawing Sheets

CONTACT HAVING INDEPENDENTLY DEFORMABLE SPRING PORTIONS AND CONNECTOR INCLUDING THE CONTACT

CROSS REFERENCE TO RELATED APPLICATIONS

Applicant claims priority under 35 U.S.C. §119 of Japanese Patent Application No. JP2009-101328 filed Apr. 17, 2009.

BACKGROUND OF THE INVENTION

The present invention relates to a contact formed by processing a single metal sheet and a connector including such a contact.

For example, this type of connector with a contact is disclosed in JP-A 2008-192627. The contact disclosed in JP-A 2008-192627 includes a box for receiving part of a circuit board, a spring portion provided within the box, and a positioner portion provided within the box for positioning the circuit board. However, there is a problem that the contact disclosed in JP-A 2008-192627 has low contact reliability because it is configured to press only one side of a circuit board in the vertical direction.

Meanwhile, another contact is disclosed in JP-A 2007-305559. The contact disclosed in JP-A 2007-305559 has an upper spring portion and a lower spring portion for sandwiching a circuit board therebetween in the vertical direction.

In the case of the contact disclosed in JP-A 2007-305559, a circuit board is vertically sandwiched by the two spring portions. The upper spring portion extends from the lower spring portion. Therefore, the upper spring portion deforms according to deformation of the lower spring portion. In other words, the contact disclosed in JP-A 2007-305559 suffers from a problem that contact pressures cannot flexibly be varied depending upon displacement of the circuit board in the vertical direction for establishing appropriate contact with the circuit board.

SUMMARY OF THE INVENTION

It is, therefore, an object of the present invention to provide a contact capable of flexibly varying contact pressures depending upon displacement of a connection target, such as a circuit board, in the vertical direction for establishing appropriate contact with the connection target.

Another object of the present invention is to provide a connector having such a contact.

One aspect of the present invention provides a contact formed of a single metal sheet. The contact includes an upper spring portion configured to press an upper surface of a plate-like connection target in a downward direction and a lower spring portion configured to press a lower surface of the plate-like connection target in an upward direction. The lower spring portion is deformable independently of the upper spring portion.

Another aspect of the present invention provides a connector having the aforementioned contact and a housing formed of an insulating material. The housing is configured to hold the contact.

An appreciation of the objectives of the present invention and a more complete understanding of its structure may be had by studying the following description of the preferred embodiment and by referring to the accompanying drawings.

Figure 1:
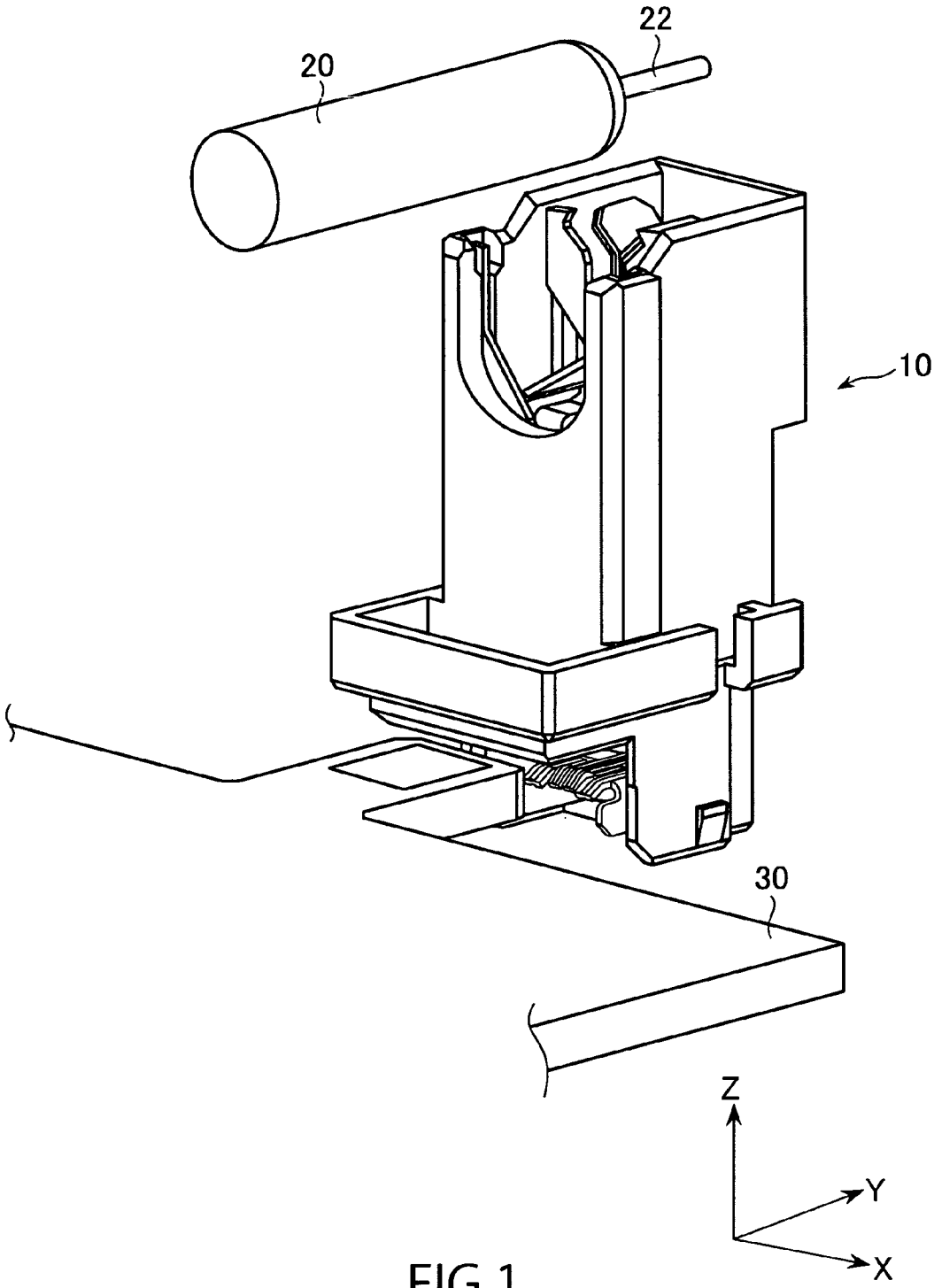
FIG. 1 is a perspective view of a connector according to an embodiment of the present invention, in which only part of a cold cathode fluorescent lamp and a circuit board is illustrated. The circuit board is to be connected to the illustrated connector. The cold cathode fluorescent lamp has not been connected to the illustrated connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
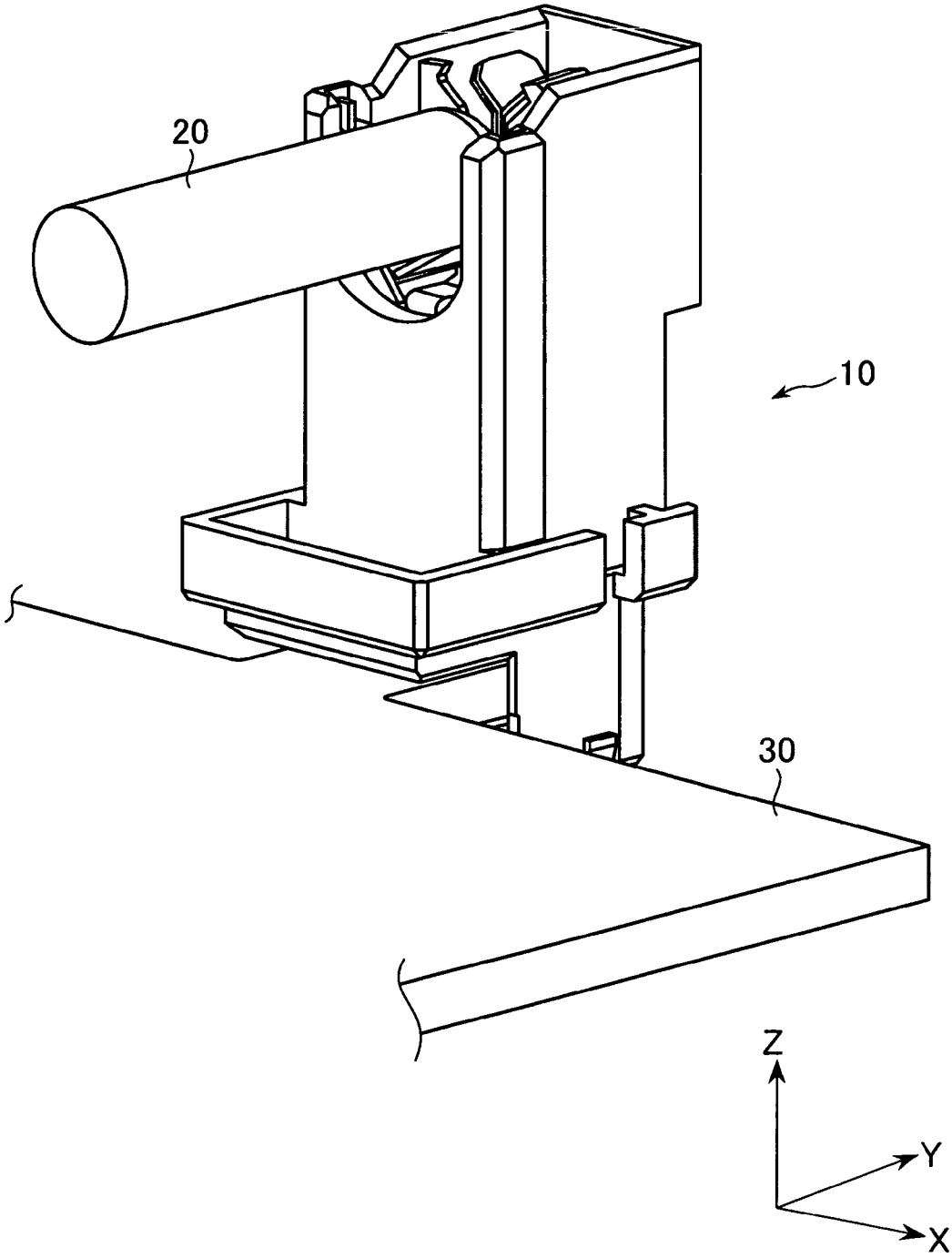
FIG. 2 is a perspective view showing that the connector shown in FIG. 1 has been connected to the circuit board and the cold cathode fluorescent lamp.
Figure 3:
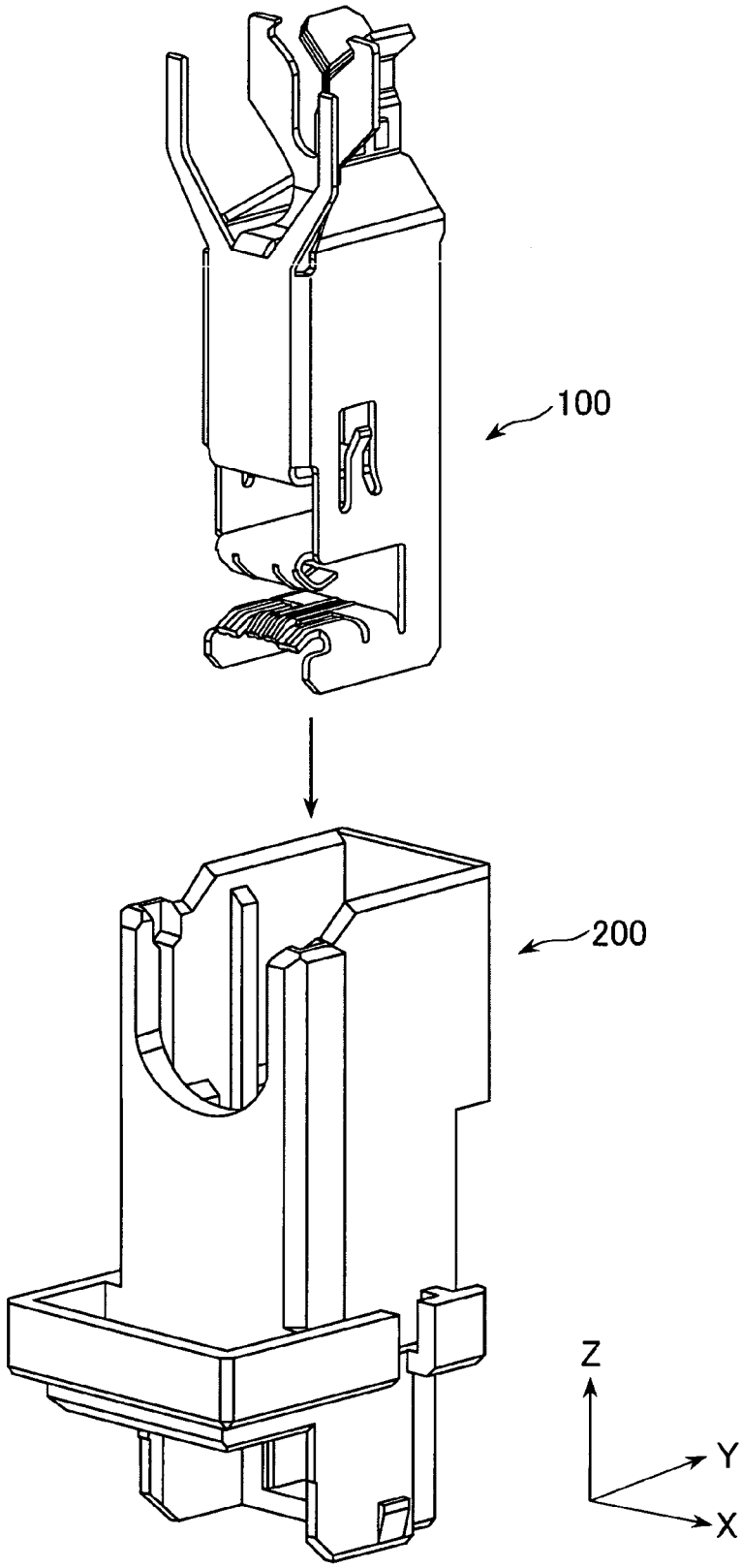
FIG. 3 is an exploded perspective view showing a contact and a housing, which form the connector shown in FIG. 1.

As shown in FIGS. 1 and 2, a connector 10 according to an embodiment of the present invention is used to electrically connect a cold cathode fluorescent lamp (CCFL) 20 and a circuit board 30 to each other. As shown in FIG. 3, the connector 10 according to the present embodiment includes a contact 100 and a housing 200 configured to hold the contact 100. The contact 100 is formed by, for example, pressing a single metal sheet.

Figure 4:
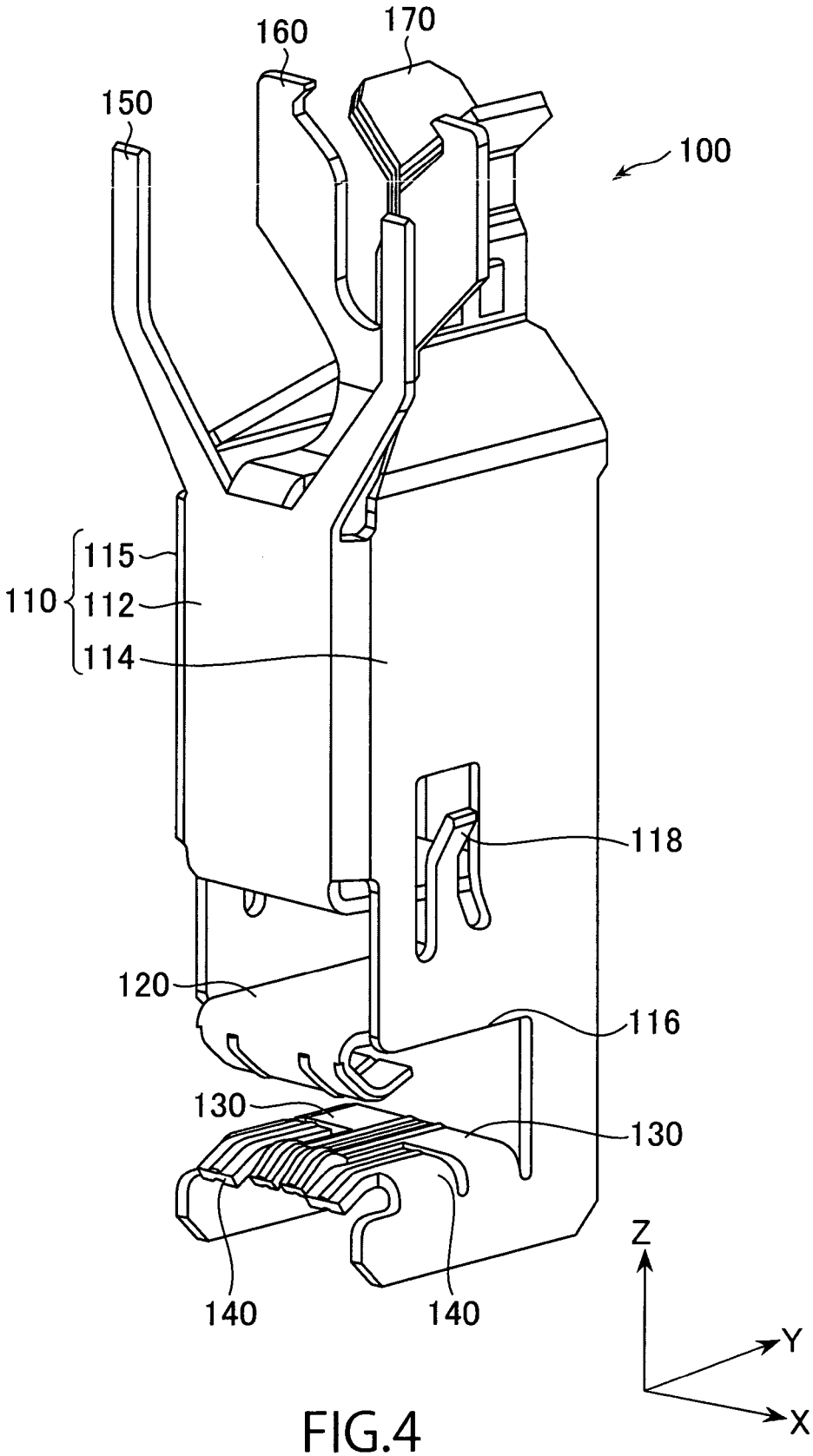
FIG. 4 is a perspective view of the contact shown in FIG. 3.
Figure 5:
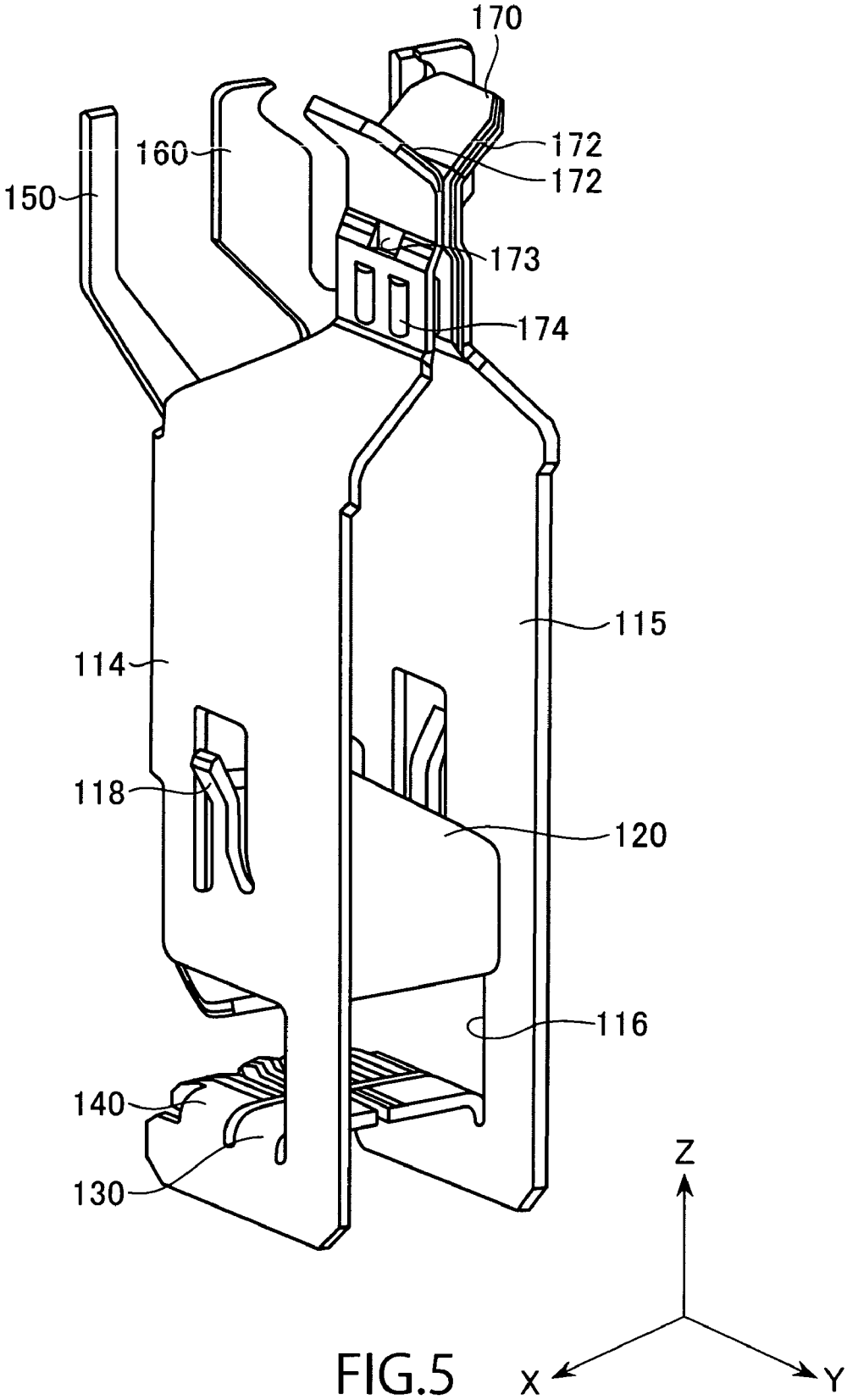
FIG. 5 is a perspective view of the contact shown in FIG. 3, as viewed along another direction.

As shown in FIGS. 4 and 5, the contact 100 according to the present embodiment has a base 110, a first spring portion including a first spring part 120, a second spring portion including two second spring parts 130, a positioner portion including two positioners 140, an arm portion including two arms 150, a CCFL positioner 160, and a holder 170.

The base 110 has a front surface 112 extending parallel to the XZ-plane. The base 110 also has a rightward surface 114 and a leftward surface 115 extending parallel to the YZ-plane. Thus, the base 110 has a roughly hook-shape as viewed along the Z-direction. Each of the rightward surface 114 and the leftward surface 115 has a lance portion 118 extending upward obliquely in the Z-direction so as to project outward.

Figure 6:
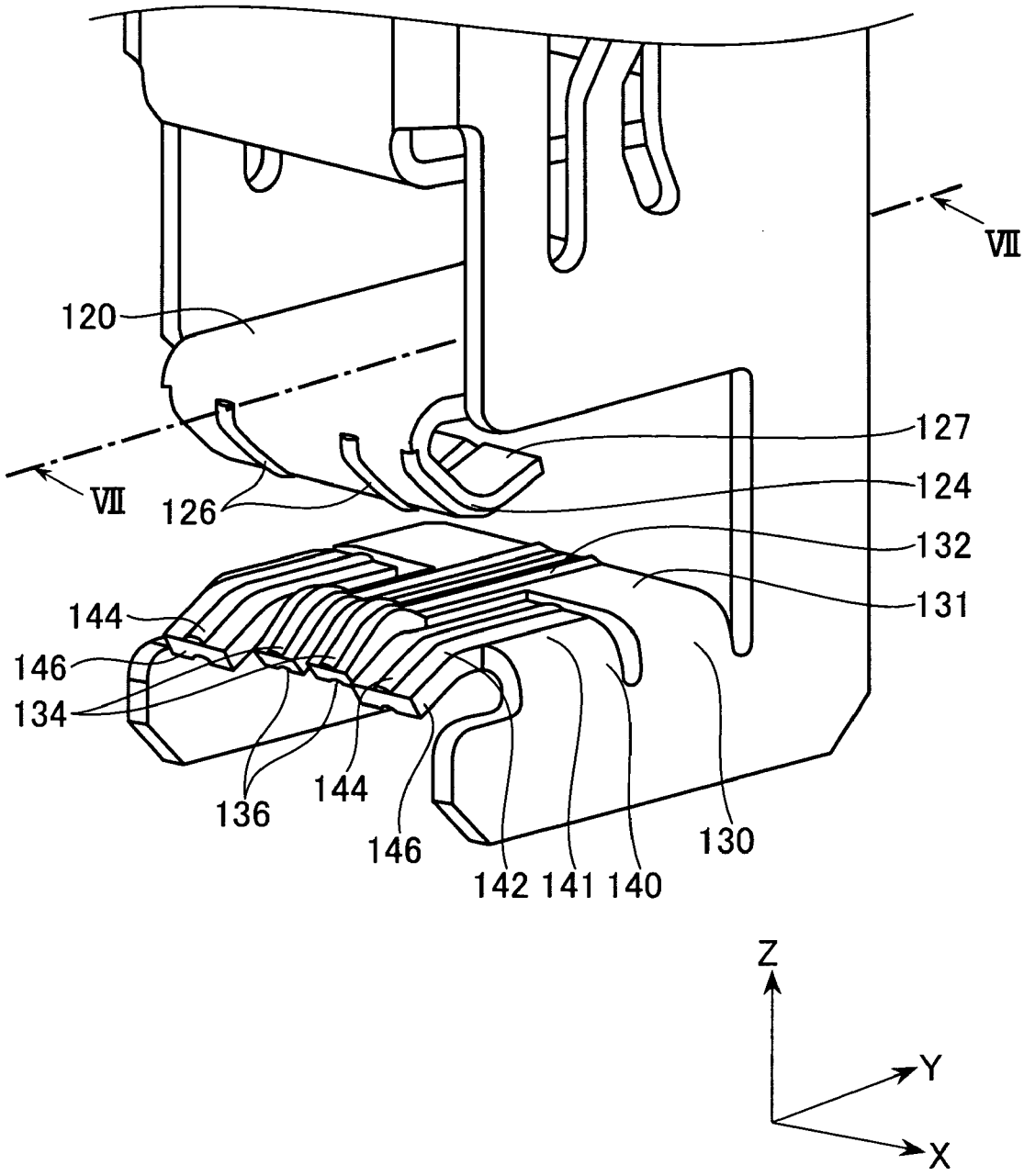
FIG. 6 is an enlarged perspective view showing a lower portion of the contact shown in FIG. 4, in which some lines are omitted.
Figure 7:
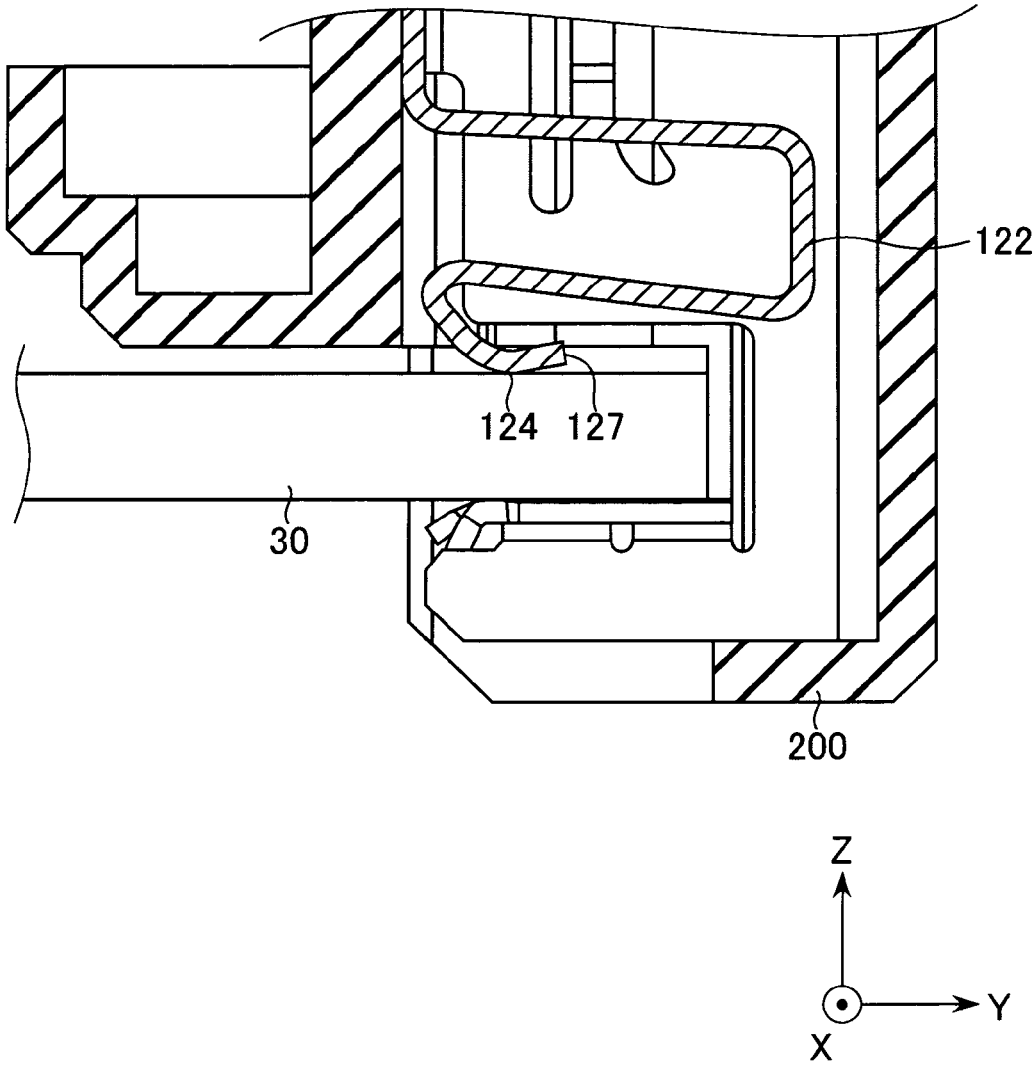
FIG. 7 is a cross-sectional view taken along line VII-VII of FIG. 6.

As shown in FIGS. 2 and 4 to 7, the first spring part 120 extends continuously from the front surface 112. The first spring part 120 is configured to press an upper surface of the circuit board 30 mounted on the contact 100 in a downward direction. Furthermore, as shown in FIGS. 6 and 7, the first spring part 120 includes a bent part 122 connected to the front surface 112 and a contacting part 124 extending obliquely rearward from the bent part 122. The bent part 122 has a roughly hook-shape as viewed along the X-direction. The contacting part 124 has a roughly doglegged shape, and a tip of the contacting part 124 is directed obliquely upward. In the present embodiment, the contacting part 124 has ribs 126 extending along the Y-direction so as to project downward in the Z-direction.

As shown in FIGS. 4 to 6, each of the second spring parts 130 is configured to press a lower surface of the circuit board 30 upward in the Z-direction. The second spring parts 130 according to the present embodiment are produced by making an L-shaped incision 116 in the rightward surface 114 and the leftward surface 115, respectively, and then bending the incised portions inward. In other words, each of the second spring parts 130 extends continuously from the rightward surface 114 or the leftward surface 115. Therefore, the second spring parts 130 can deform independently of the first spring part 120, which extends continuously from the front surface 112. In the present embodiment, each of the second spring parts 130 includes a first part 131 extending along the X-direction and a second part 132 extending along the Y-direction and has a roughly L-shape. The second spring parts 130 are opposed to each other such that the second parts 132 are arranged in parallel to each other. The second spring parts 130 are arranged to be mirror images as viewed along the Z-direction. The second part 132 of each second spring part 130 includes a rib 134 extending along the Y-direction so as to project upward in the Z-direction.

As shown in FIGS. 2 and 4 to 6, the positioners 140 serve to position the circuit board 30 in the Z-direction. The positioners 140 are produced by making an L-shaped incision 116 in the rightward surface 114 and the leftward surface 115, respectively, and then bending the incised portions inward, as with the second spring parts 130. Each of the positioners 140 extends continuously from the rightward surface 114 or the leftward surface 115. The positioners 140 according to the present embodiment are aligned parallel to the second spring parts 130. Each of the positioners 140 includes a first part 141 extending along the X-direction and a second part 142 extending along the Y-direction and has a roughly L-shape, which is smaller than the shape of the corresponding second spring part 130. Since the length of the first part 141 and the second part 142 of each positioner 140 is shorter than that of the first part 131 and the second part 132 of the corresponding second spring part 130, the positioners 140 are more rigid than the second spring parts 130. Thus, the positioners 140 can serve to position the circuit board 30. In the preset embodiment, a connecting portion where each positioner 140 is connected to the side surface (the rightward surface 114 or the leftward surface 115) is located in front of a connecting portion where the corresponding second spring part 130 is connected to the side surface as viewed along the Y-direction. In other words, a boundary portion between each positioner 140 and the side surface is located in front of a boundary portion between the corresponding second spring part 130 and the side surface. Each of the positioners 140 includes a rib 144 extending along the Y-direction so as to project upward in the Z-direction.

As shown in FIG. 4, the arm portion includes bifurcated arms 150 extending upward along the Z-direction from the front surface 112 of the base 110. In the present embodiment, the arms 150 are parts used to connect a blank (an intermediate) of the contact 100 to a carrier. When the contact 100 is produced, the arms 150 are separated from the carrier.

Figure 10:
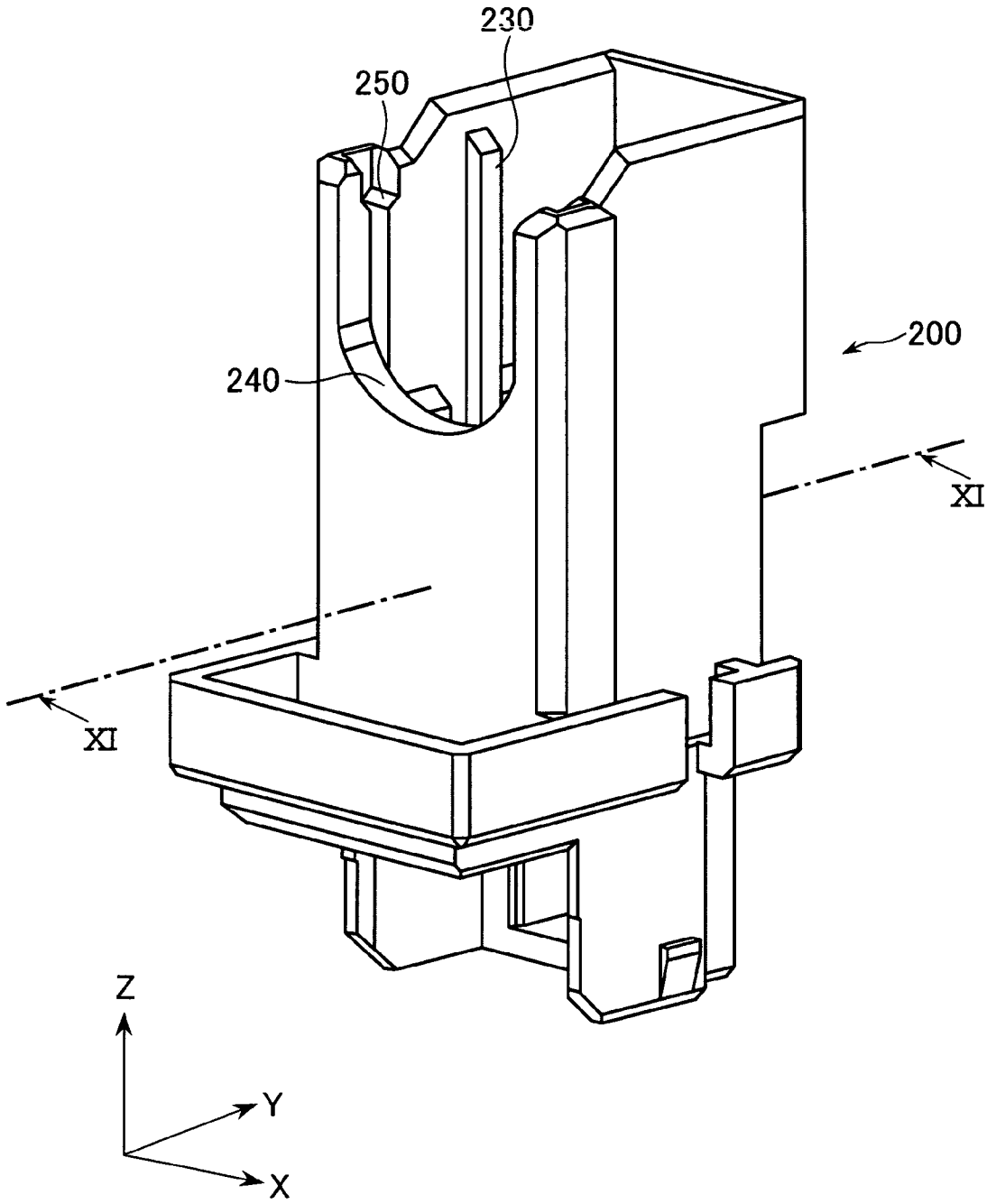
FIG. 10 is a perspective view of the housing shown in FIG. 3.
Figure 11:
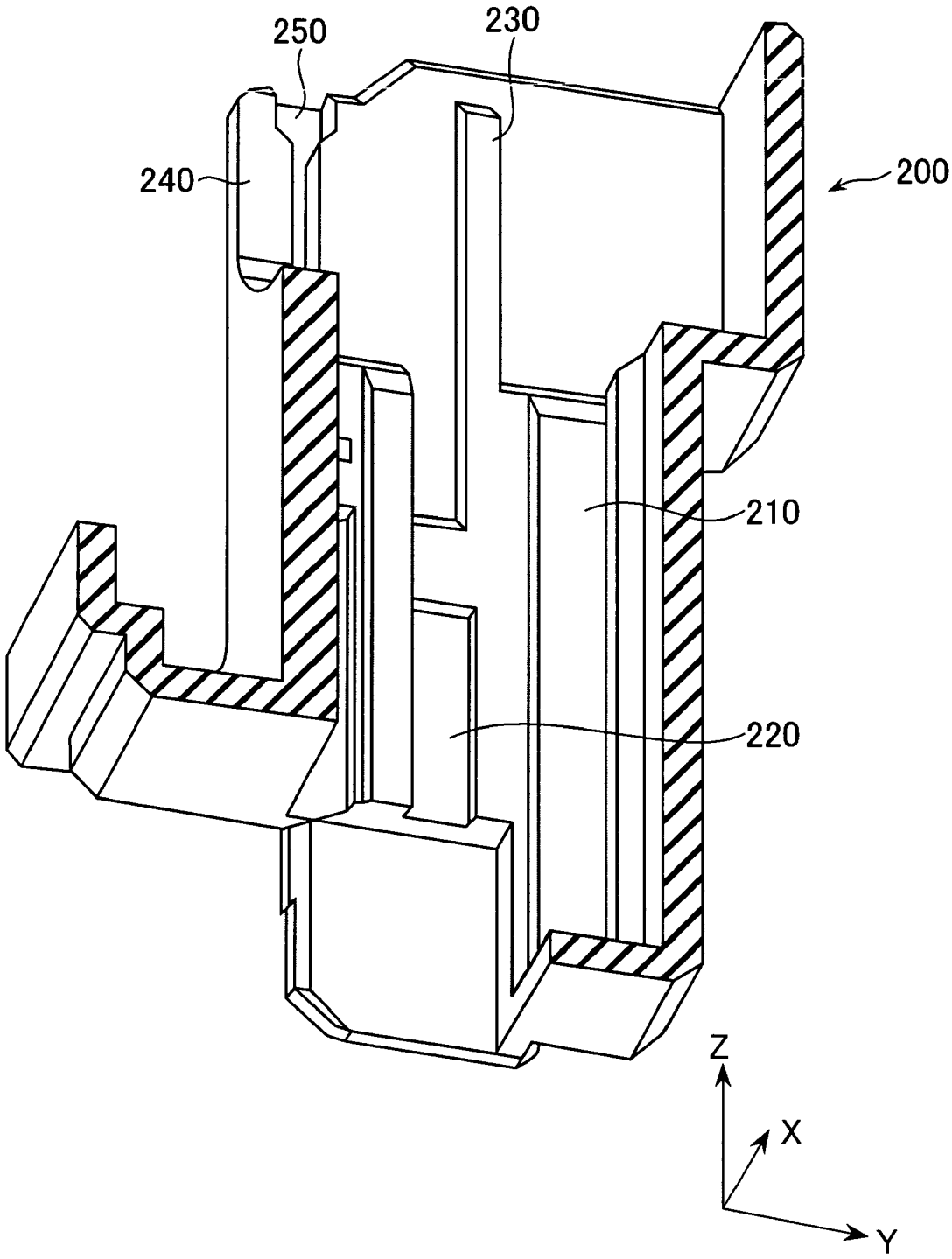
FIG. 11 is a cross-sectional view taken along line XI-XI of FIG. 10.

As shown in FIGS. 1, 2, and 4, the CCFL positioner 160 extends from the front surface 112 of the base 110 toward the holder 170 and has a roughly Y-shape. The CCFL positioner 160 of the present embodiment defines the bottom dead center of the cold cathode fluorescent lamp 20. Additionally, the CCFL positioner 160 serves to prevent displacement of the cold cathode fluorescent lamp 20 due to thermal expansion of the cold cathode fluorescent lamp 20, along with displacement prevention portions 230 of the housing 200 (see FIG. 10), which will be described later.

FIGS. 1, 2, 4, and 5, the holder 170 serves to hold a terminal 22 of the cold cathode fluorescent lamp 20. The holder 170 includes tip portions 172 extending upward in the Z-direction so as to separate from each other, detachment prevention portions 173 for preventing an inserted terminal 22 from being detached upward in the Z-direction, and protrusions 174 projecting outward in the X-direction. The tip portions 172 guide the terminal 22 when the terminal 22 is inserted. Each of the detachment prevention portions 173 is produced by making a hook-shape incision in part of the holder 170 and then bending the incised portion inward in the X-direction. Each of the detachment prevention portions 173 has an end directed downward in the Z-direction. Furthermore, the detachment prevention portions 173 contact each other in the X-direction. The terminal 22 is inserted into a location where the protrusions 174 are formed. Therefore, even if the inserted terminal 22 moves upward in the Z-direction, it strikes the lower ends of the detachment prevention portions 173. Thus, this structure prevents detachment of the terminal 22. Furthermore, the protrusions 174 are provided to reduce a contact area between the terminal 22 of the cold cathode fluorescent lamp 20 and the holder 170. Thus, the protrusions 174 can reduce wear due to movement of the terminal 22.

As shown in FIGS. 1, 2, and 4 to 7, the ribs 126 of the first spring part 120, the ribs 134 of the second spring parts 130, and the ribs 144 of the positioners 140 can increase local contact pressures between the contact 100 and the circuit board 30. Accordingly, the connector 10 of the present embodiment can have high contact reliability with the circuit board 30. Furthermore, the second part 132 of each second spring part 130 has an end 136 directed obliquely downward in the Z-direction, and the second part 142 of each positioner 140 has an end 146 directed obliquely downward in the Z-direction. Therefore, as can be seen from FIGS. 1 and 6, the circuit board 30 is guided by the contacting part 124 of the first spring part 120, the ends 136 of the second spring parts 130, and the ends 146 of the positioners 140 and inserted between the first spring part 120 and the second spring parts 130. Accordingly, buckling and deformation of the contact 100 can be prevented.

As shown in FIGS. 1 to 4, 10, and 11, the housing 200 holds the contact 100. The housing 200 includes pressing portions 210 projecting inward, fixing grooves 220 extending along the Z-direction, displacement prevention portions 230 projecting inward, an insertion portion 240 in which the cold cathode fluorescent lamp 20 is inserted, and guiding grooves 250 extending along the Z-direction. The pressing portions 210 are brought into contact with the rightward surface 114 and the leftward surface 115 of the contact 100, respectively, when the contact 100 is pressed into the housing 200. Thus, the contact 100 is held by the housing 200. The fixing grooves 220 serve to prevent the contact 100 pressed in the housing 200 from being detached from the housing 200. Specifically, the contact 100 is pressed into the housing 200 until each of the lance portions 118 is located within the corresponding fixing groove 220. At that time, even if the contact 100 is to move upward, ends of the lance portions 118 strike upper edges of the fixing grooves 220. Thus, the contact 100 is prevented from being detached from the housing 200. Front surfaces of the displacement prevention portions 230 in the Y-direction are brought into contact with the CCFL positioner 160 of the contact 100 in a state in which the contact 100 is held by the housing 200. Even if the CCFL positioner 160 is to be pushed in the Y-direction by thermal expansion of the cold cathode fluorescent lamp 20, displacement of the CCFL positioner 160 in the Y-direction is prevented by the above structure. The guiding grooves 250 serve to guide the arms 150 when the contact 100 is pressed into the housing 200. With the guiding grooves 250, the contact 100 can be pressed into the housing 200 at a proper position.

As described above, the contact 100 according to the present embodiment include the first spring part 120, which has high spring characteristics, and the second spring parts 130, which have low spring characteristics. Furthermore, the positioners 140 are provided near the second spring parts 130, which have low spring characteristics. Therefore, the circuit board 30 is pressed against the positioners 140 by the first spring part 120. Thus, the contact 100 according to the present embodiment includes spring portions that have different spring characteristics and can deform independently of each other. Accordingly, the circuit board 30 can reliably be held in the vertical direction by those spring portions. Hence, even if the circuit board 30 moves in the Z-direction, the contact 100 can establish appropriate contact with the circuit board 30 because contact pressures between the first spring part 120 and the circuit board 30 and between the second spring parts 130 and the circuit board 30 can be varied separately depending upon the movement of the circuit board 30. Additionally, as shown in FIG. 4, the first spring part 120 extends continuously from a part of the base 110 (the front surface 112), which extends in a direction perpendicular to or almost perpendicular to the insertion direction of the circuit board 30 (the Y-direction), and the second spring parts 130 extend continuously from the side surfaces of the base 110 (the rightward surface 114 and the leftward surface 115). Thus, a small single sheet can efficiently be used to produce the contact 100. Accordingly, the contact 100 can be produced at lower cost.

Figure 8:
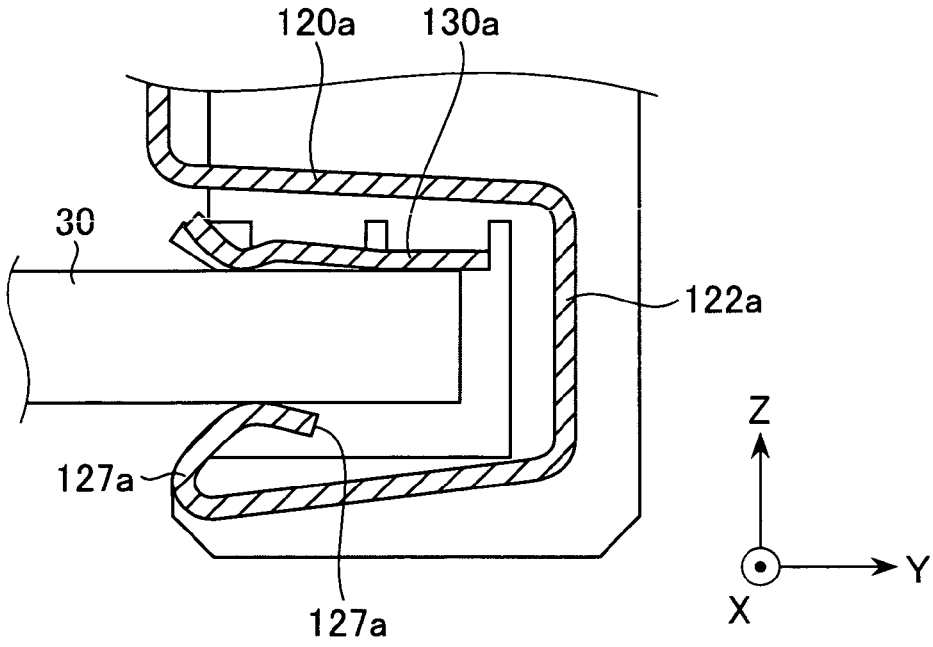
FIG. 8 is a partial cross-sectional view showing a variation of an upper spring portion and a lower spring portion of the contact according to the embodiment of the present invention.
Figure 9:
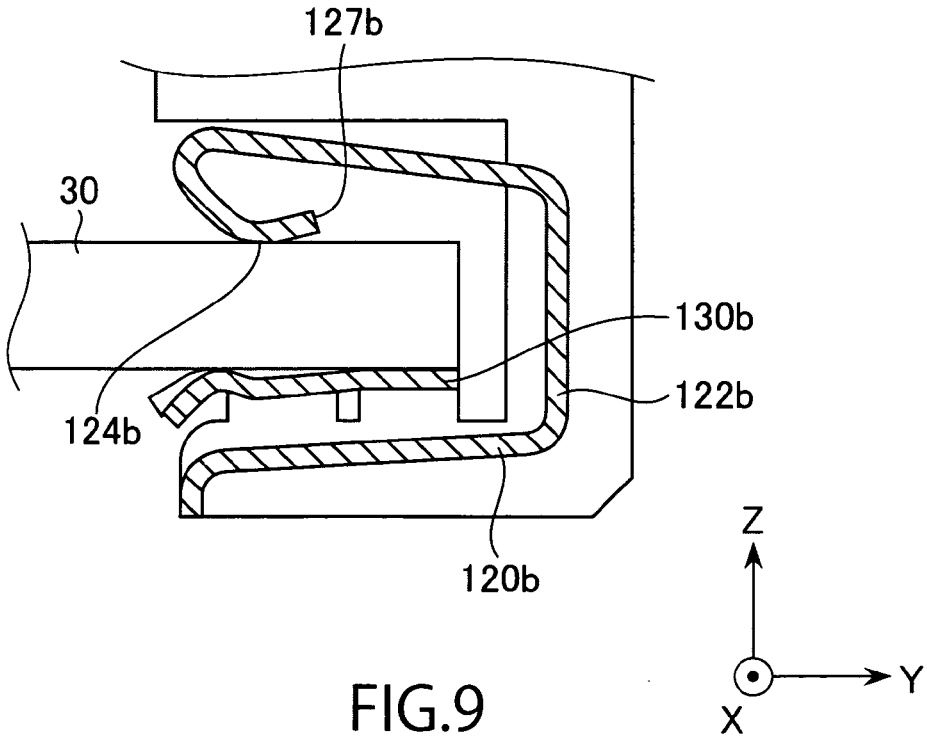
FIG. 9 is a partial cross-sectional view showing another variation of the upper spring portion and the lower spring portion of the contact according to the embodiment of the present invention.

In the contact 100 of the present embodiment, as shown in FIG. 4, the first spring part 120 is used as an upper spring in the Z-direction, and the second spring parts 130 are used as lower springs in the Z-direction. Nevertheless, the present invention is not limited to this embodiment. For example, as shown in FIG. 8, the first spring part 120*a* may be used as a lower spring, and the second spring parts 130*a* may be used as upper springs. In this case, the bent part 122*a* of the first spring part 120*a* extends behind the second spring parts 130*a*. With such a configuration, the circuit board 30 can be held in the vertical direction by the first spring part 120*a* and the second spring parts 130*a*. Furthermore, as shown in FIGS. 4 and 9, the first spring part 120*b* may extend as an upper spring from a lower portion of the front surface 112 of the base 110. Furthermore, the shape of the base 110 shown in FIG. 4 may be symmetrized with respect to the X-direction, so that the rear surface, the rightward surface, and the leftward surface form a hook-shape. In this case, the first spring part may extend from an upper portion of the rear surface if it is used as an upper spring. The first spring part may extend from a lower portion of the rear surface if it is used as a lower spring. With such a structure, the rear surface should be extended to form the CCFL positioner 160 and the like. Therefore, a large single plate is required to form the contact, and the structure of the contact becomes complicated. Accordingly, the contact 100 should preferably have a shape as shown in FIG. 4.

As described above, a contact according to the present invention has an upper spring portion and a lower spring portion deformable independently of each other. A connection target such as a circuit board is held in the vertical direction by those spring portions. Therefore, contact pressures between the upper spring portion and the connection target and between the lower spring portion and the connection target can be varied separately depending upon displacement of the connection target in the vertical direction. Accordingly, appropriate contact with the connection target can be established.

The present application is based on a Japanese patent application of JP2009-101328 filed before the Japan Patent Office on Apr. 17, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A contact formed of a single metal sheet, the contact comprising:

an upper spring portion configured to press an upper surface of a plate-like connection target in a downward direction;

a lower spring portion configured to press a lower surface of the plate-like connection target in an upward direction, the lower spring portion being deformable independently of the upper spring portion; and a base having two side surfaces and a front surface or a rear surface;

wherein spring characteristics of the upper spring portion are different from spring characteristics of the lower spring portion;

wherein the two side surfaces and the front surface or the rear surface form a hook-shape on a horizontal plane;

wherein one of the upper spring portion and the lower spring portion is formed as a first spring portion which extends continuously from the front surface or the rear surface; and wherein a remaining one of the upper spring portion and the lower spring portion is formed as a second spring portion which extends continuously from the side surface.

2. The contact as recited in claim 1, wherein the first spring portion extends continuously from the front surface.

3. The contact as recited in claim 1, wherein the remaining one of the upper spring portion and the lower spring portion is produced by making an L-shaped incision in the side surface, respectively, and then bending the incised portions inward.

4. The contact as recited in claim 1, wherein the second spring portion is formed by bending part of the two side surfaces so as to have ends facing each other at a center of the contact in a horizontal direction.

5. The contact as recited in claim 4, further comprising a positioner portion for positioning the plate-like connection target in a vertical direction, the positioner portion extending continuously from the two side surfaces and being aligned parallel to the second spring portion.

6. The contact as recited in claim 5, wherein:

the second spring portion comprises two L-shaped spring parts arranged to be mirror images as viewed along the vertical direction; and the positioner portion comprises two L-shaped positioners smaller than the two L-shaped spring parts.

7. The contact as recited in claim 5, further comprising: a first boundary portion between the second spring portion and the side surface; and a second boundary portion between the positioner portion and the side surface, the second boundary portion being located in front of the first boundary portion.

8. A connector comprising:

a contact formed of a single metal sheet, the contact comprising an upper spring portion, a lower spring portion, and a base having two side surfaces and a front surface or a rear surface, the upper spring portion being configured to press an upper surface of a plate-like connection target in a downward direction, the lower spring portion being configured to press a lower surface of the plate-like connection target in an upward direction, the lower spring portion being deformable independently of the upper spring portion; and a housing formed of an insulating material, the housing being configured to hold the contact;

wherein spring characteristics of the upper spring portion are different from spring characteristics of the lower spring portion;

wherein the two side surfaces and the front surface or the rear surface form a hook-shape on a horizontal plane;

wherein one of the upper spring portion and the lower spring portion is formed as a first spring portion which extends continuously from the front surface or the rear surface; and wherein a remaining one of the upper spring portion and the lower spring portion is formed as a second spring portion which extends continuously from the side surface.

9. The connector as recited in claim 8, wherein the first spring portion extends continuously from the front surface.

10. The connector as recited in claim 8, wherein the second spring portion is produced by making an L-shaped incision in the side surface, respectively, and then bending the incised portions inward.

11. The connector as recited in claim 8, wherein the second spring portion is formed by bending part of the two side surfaces so as to have ends facing each other at a center of the contact in a horizontal direction.

12. The connector as recited in claim 11, wherein the contact further includes a positioner portion for positioning the plate-like connection target in a vertical direction, the positioner portion extending continuously from the two side surfaces and being aligned parallel to the second spring portion.

13. The connector as recited in claim 12, wherein:

the second spring portion comprises two L-shaped spring parts arranged to be mirror images as viewed along the vertical direction; and the positioner portion comprises two L-shaped positioners smaller than the two L-shaped spring parts.

14. The connector as recited in claim 12, wherein the contact further includes:

a first boundary portion between the second spring portion and the side surface; and a second boundary portion between the positioner portion and the side surface, the second boundary portion being located in front of the first boundary portion.

* * * * *